United States Patent [19]

Mandel

[11] 4,433,792

[45] Feb. 28, 1984

[54] OPENING AND STOPPER DEVICE

[76] Inventor: George Mandel, 62 Long View Ct., Danville, Calif. 94526

[21] Appl. No.: 427,500

[22] Filed: Sep. 29, 1982

[51] Int. Cl.[3] ..... B65D 17/34

[52] U.S. Cl. ..... 220/269; 220/336

[58] Field of Search ..... 220/269, 270, 336, DIG. 19

[56] References Cited

U.S. PATENT DOCUMENTS

| | | | |
|---|---|---|---|
| 4,207,991 | 6/1980 | Amabili | 220/336 |
| 4,234,099 | 11/1980 | Tarro | 220/269 |
| 4,339,053 | 7/1982 | Tarro | 220/269 |

*Primary Examiner*—George T. Hall

*Attorney, Agent, or Firm*—Bielen & Peterson

[57] ABSTRACT

An integral opening and recapping device incorporated in the top of conventional aluminium top container constructed with an opening tab pivotally mounted to a pivot rivet centrally located on the container top, the tab having a detent edge engageable with a scored aperture flap for forced displacement of the flap to form an aperture, the tab having further a lever portion for operating the detent edge, the underside of the lever portion forming a sealing lip which on pivoting of the tab about the rivet, is engageable with the aperture to hermetically seal the container.

7 Claims, 4 Drawing Figures

OPENING AND STOPPER DEVICE

BACKGROUND OF THE INVENTION

This invention relates to an opening and resealing device for cans having an aluminium top. The invention specifically relates to opening devices known as pop-tops of the antilitter type commonly used for beverage cans. The opening and resealing device is constructed with a sealing lip incorporated in the underside of the operating tab to form a stopper member to reseal the container.

The operating tab is conventionally used for separating a prescored portion of the can top from the remaining top and depressing the flap that is formed into the can without disconnection of the flap from the can. The tab is conventionally connected to a rivet pin at the center of the can top and operates as a lever with a manual lifting portion on one side of the pin and a reacting detent portion on the other side of the pin, which engages the edge of the scored flap for depressing the flap into the can. Once opened, no provision on the tab mechanism has been provided for resealing the can. Certain plastic lid covers engageable with the circumferential rim of the can top are available for covering the entire top of the can and resealing the contents. Generally for the type of can usually employing a pop-top opening device, such covers are not provided with the can, and the user is most often left without a resealing means and must discard unconsumed contents with the can.

The opening and sealing device of this invention improves the mechanism conventionally used for opening beverage-type pop-top cans and integrally incorporates a sealing means into an altered opening tab.

The resealing means comprises a projecting sealing lip, preferably a semideformable composition that is integrally incorporated on the underside of the tab. After an aperture has been formed in the can top by lifting the tab causing the scored portion of the top to be depressed, the tab is pivoted 180° on the rivet pin centering the sealing lip over the formed aperture. The tap is then downwardly pressed, engaging the lip with the formed aperture and sealing the can top.

SUMMARY OF THE INVENTION

The opening and resealing device of this invention is an improvement in conventional pop-top type can opening devices. The improvement is directed to a stopper member incorporated directly in the tab portion of the opening mechanism, and permits the mechanism to function both as an opening device and a resealing device. Partially consumed contents of aluminium top can may be resealed at the option of the user at little or no additional cost in container fabrication.

The resealing means comprises a lip that projects from the underside of the tab. The sealing lip is constructed to conform to the aperture formed when the can is opened. The sealing lip is formed by stamping the tab during fabrication to provide a projection that is insertable into the drinking aperture. To improve the seal the formed lip is coated with a nylon or other deformable synthetic composition. The sealing lip is engaged by pivoting the tab around the central pivot rivet until the lip is centered directly over the drinking aperture. The tab is then pressed downward to force the projecting lip on the underside of the tab into the aperture. To reopen, the tab is lifted under its distal edge, disengaging the lip from the aperture.

The resealing lip is designed to be integrally formed in the tab mechanism for aluminium top cans and is discarded with the can. While designed primarily for drinking containers, the opening and resealing device is suitable for a variety of aluminium top cans where only a portion of the top is to be opened. For example, sauce cans and peanut cans may be fabricated with a wide-mouth opening for pouring out the contents. The tab construction is simply of larger configuration to accomodate a comparatively large sealing lip on its underside. The size, however, is limited by the necessity of a pivot rivet located substantially in the central position of the top, thereby restricting the opening to a sector of the can top. Further, the size of the opening is restricted by the ability of the tab detent edge to initiate separation of the scored portion of the can top to form the dispensing aperture.

While formation of an insertion lip by stamping means and providing sealing film on the lip is most cost effective, the stopper member may be entirely formed of a rubber-like or deformable plastic material secured to the underside of a flat tab. However, this construction may be more likely to cause undesirable separation of the plastic material from the tab during reopening. The features of the preferred embodiment are described in greater detail in the detailed description of the preferred embodiment.

DETAILED DESCRIPTION OF THE PREFERRED EMBODIMENTS

Figure 1:
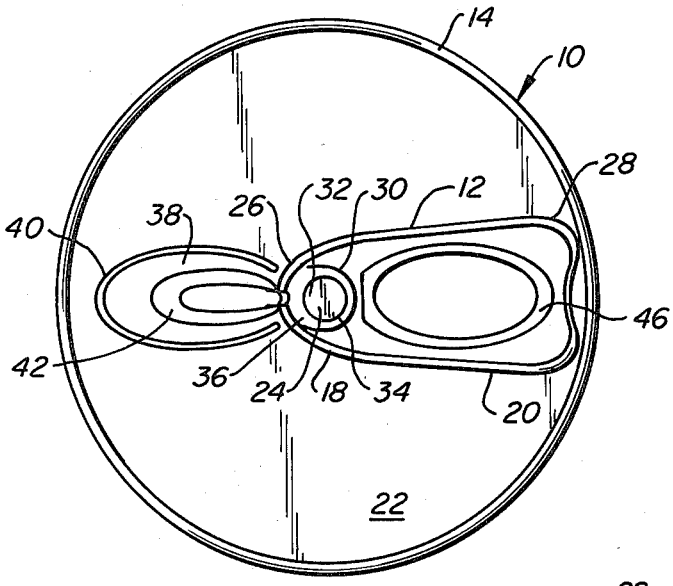
FIG. 1 is a top view of a container having the opening and resealing mechanism.

Referring to FIG. 1 conventional aluminium top container 10 is shown with an opening and resealing device 12 of this invention. The container 10 has a peripheral rolled edge 14 of material of the same composition as the body 16 of the container shown in FIG. 2. This material in the preferred embodiment is aluminium, but may comprise steel as is common in certain bimetal containers. Alternately, the rolled edge may comprise a metal and the body of the container may comprise a plastic or cardboard as in certain containers for nuts or the like. The particular container shown is designed and sized for beverages, which is the principal expected use for the opening and resealing device shown.

Figure 2:
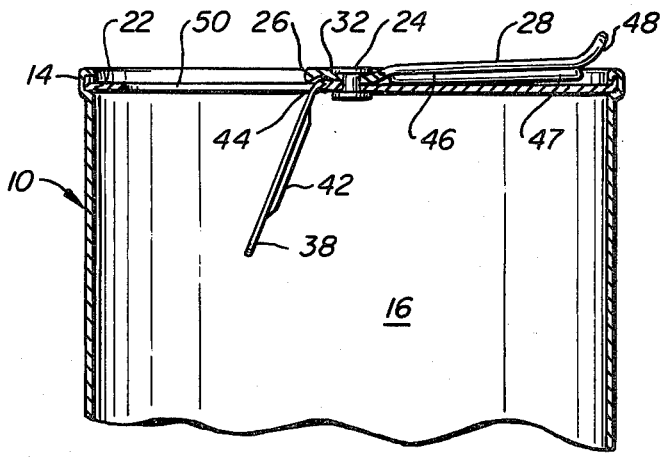
FIG. 2 is a fragmented side elevational view partially in cross section of the container of FIG. 1 with an open drinking aperture.
Figure 3:
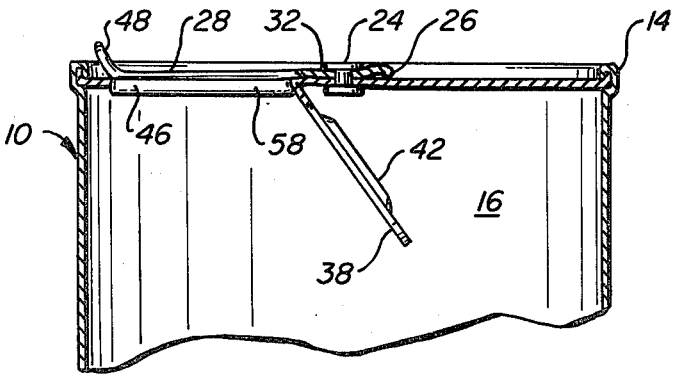
FIG. 3 is a fragmented side elevational view partially in cross section of the container of FIG. 1 with a resealed drinking aperture.

The opening and resealing device comprises a tab mechanism 18, which includes a displaceable tab 20 connected to an aluminium container top 22 by a pivot rivet 24. The pivot rivet 24 pins the tab 20 to the container top as shown in FIG. 2 and permits the tab to be both lifted in part in lever fashion with the rivet generating a fulcrum point, and pivoted with the rivet functioning as a pivot post. The tab 20 has a detent edge 26 on one side of the rivet 24 and a manual lever section 28 on the opposite side of the rivet. The tab 20 includes a semi-circular slit 30, which allows the lever section 28 to manually lifted and the detent edge to be downwardly directed against the container top 22. The lever action is generated by the lead edge 32 of the rivet acting on the pinned section 34 of the tab to form a hinge crease 36.

The detent edge 26 of the tab 20 presses against an aperture flap 38 that initially is a composite section of the aluminium top defined by a scoring 40. The scoring 40 forms a horse shoe shaped loop in front of the detent edge and cooperates with a horse shoe flute 42, which stiffens the flap 38, to facilitate separation of the flap from the remainder of the top as shown in FIG. 2. The flap 38 remains connected to the top by an unscored hinge portion 44 and is downwardly directed into the container out of the way of a user.

The lever section 28 of the tab 20 as shown in FIG. 2 has a downwardly directed lip 46 on the underside of the tab which forms a stopper member 47.

Figure 4:
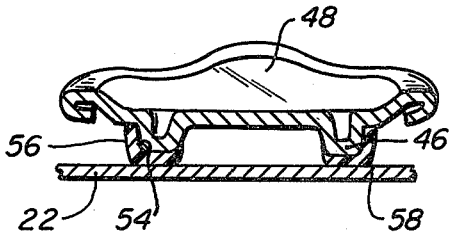
FIG. 4 is an elevational cross sectional view of the tab portion of the opening mechanism for the container of FIG. 1

The lip 46 is displaced from an angled terminal edge 48 to allow the tab to be easily engaged by the fingers of a user to open the container initially or to open the container after resealing. The outer configuration of the lip 46 conforms to the aperture 50 remaining when the flap 38 is displaced from the top on opening. As shown in FIG. 4, the lip 46 is fabricated by stamping the tab to form a slightly outwardly angled face 54. The angled face 54 is coated with a plastic material 56 to form a filler film 58 such that the finished face is substantially flat or preferably inwardly angled as the lip projects. This construction allows the lip 46 to be inserted into the aperture 50 and resist dislocation. The plastic material compresses or deforms to conform to any irregularities in the matching of lip and aperture thereby providing a hermetic seal.

After opening the pivot rivet allows the tab to be pivoted such that the lever section 28 and lip 46 is aligned over the complimentary configured aperture 50.

Where the lever section 28 is downwardly pressed the lip 46 on the tab is displaced into the aperture. Because the flap remains hinged to the top, the lip incidentally forces the flap further into the can during the sealing operation.

To reopen the container, the upwardly angled terminal edge 48 of the tab is engaged by the user's finger tips and lifted. The tab is then pivoted to an out of the way position. The resealing device can be reused until the contents of the container are gone.

While on the foregoing embodiments of the present invention have been set forth in considerable detail for the purposes of making a complete disclosure of the invention, it may be apparent to those of skill in the art that numerous changes may be made in such detail without departing from the spirit and principles of the invention.

I claim:

1. In a container having a aluminium top with a tab opening mechanism engaging a scored flap in said top for forming a contents dispensing aperture, the improvement comprising; a resealing means on said tab opening machanism for hermetically resealing said aperture, wherein said tab mechanism includes a pivot element centrally connected to said aluminium top and a tab member having a finger lift portion and a detent edge, said tab member being pivotally connected to said pivot element between said finger left portion and said detent edge, said detent edge being directed at said scored flap for separating said flap from said aluminium top and depressing said flap into said container on lifting said lift portion and, wherein said resealing means comprises a stopper member incorporated on the underside of said lift portion of said tab member, said stopper member having a configuration complimentary to said aperture formed on opening said container said stopper member being inserted in said aperture by pivoting said tab member to locate said stopper member over said aperture and depressing said lift portion of said tab member.

2. The improved tab mechanism for aluminium top containers of claim 1, wherein said stopper member comprises a downwardly projecting sealing lip stamped into said lift position of said tab member, said sealing lip having an outer configuration conforming to said dispensing aperture.

3. The improved tab mechanism of claim 2, wherein said sealing lip includes an outer coated layer of deformable material for conforming to said dispensing aperture.

4. The improved tab mechanism of claim 1, wherein said stopper member comprises a projection element on the underside of said left portion of said tab, said projecting element being engageable with said dispensing aperture to seal said container.

5. The improved tab mechanism of claim 4, wherein said projecting element is deformable for conforming to said dispensing aperture.

6. The improved tab mechanism of claim 4 wherein said projecting element has a deformable surface for conforming to said dispensing aperture.

7. The improved tab mechanism of claim 1 wherein said left portion of said tab member has an upwardly angled edge adapted for engagement by a user's fingers.

* * * * *

Notice of Adverse Decision in Interference

In Interference No. 101,479, involving Patent No. 4,433,792, G. Mandel, OPENING AND STOPPER DEVICE, final judgment adverse to the patentee was rendered Aug. 18, 1986, as to claims 1–7.

[*Official Gazette December 2, 1986.*]